US012296430B2

(12) United States Patent
Song et al.

(10) Patent No.: US 12,296,430 B2
(45) Date of Patent: May 13, 2025

(54) JET POLISHING DEVICE FOR STABLY FORMING SHAPE OF GAUSSIAN REMOVAL FUNCTION

(71) Applicant: National University of Defense Technology, Changsha (CN)

(72) Inventors: Ci Song, Changsha (CN); Guipeng Tie, Changsha (CN); Zhiqiang Zhang, Changsha (CN); Feng Shi, Changsha (CN); Ye Tian, Changsha (CN)

(73) Assignee: National University of Defense Technology, Changsha (CN)

( * ) Notice: Subject to any disclaimer, the term of this patent is extended or adjusted under 35 U.S.C. 154(b) by 350 days.

(21) Appl. No.: 18/082,042

(22) Filed: Dec. 15, 2022

(65) Prior Publication Data

US 2023/0201998 A1 Jun. 29, 2023

(30) Foreign Application Priority Data

Dec. 28, 2021 (CN) ..... 202111632010.3

(51) Int. Cl.
*B24C 1/08* (2006.01)
*B24B 49/16* (2006.01)
(Continued)

(52) U.S. Cl.
CPC ..... *B24C 1/08* (2013.01); *B24B 49/16* (2013.01); *B24C 1/045* (2013.01); *B24C 3/04* (2013.01); *B24C 5/04* (2013.01)

(58) Field of Classification Search
CPC .. B24C 1/04; B24C 1/045; B24C 1/08; B24C 3/04; B24C 3/08; B24C 3/12; B24C 3/22;
(Continued)

(56) References Cited

U.S. PATENT DOCUMENTS 5,477,025 A * 12/1995 Everett ..... B23K 26/144 219/121.84
8,826,973 B2 * 9/2014 Moxley ..... E21B 21/103 166/384

(Continued)

FOREIGN PATENT DOCUMENTS

CN 108356712 B * 1/2020 ..... B24C 1/08
CN 111482905 A * 8/2020

*Primary Examiner* — Eileen P Morgan
(74) *Attorney, Agent, or Firm* — Leason Ellis LLP

(57) ABSTRACT

A jet polishing device capable of stably forming a Gaussian removal function includes: an auxiliary mounting mechanism; a jet machining mechanism. The jet machining mechanism is connected with the auxiliary mounting mechanism, the jet machining mechanism includes a rotation driving assembly, a positioning assembly and a jet machining assembly, the positioning assembly includes a linear guide rail, a slide mass, a first laser and a second laser, the rotation driving assembly is connected with the linear guide rail, the slide mass is slidably connected to the linear guide rail, the first laser is fixedly arranged relative to the linear guide rail, the jet machining assembly includes a mounting bracket fixedly connected with the slide mass, a nozzle mounting body rotatably connected to the mounting bracket and a nozzle arranged on the nozzle mounting body, and the second laser is connected with the nozzle mounting body.

10 Claims, 5 Drawing Sheets

(51) Int. Cl.

| | |
|---|---|
| ***B24C 1/04*** | (2006.01) |
| ***B24C 3/04*** | (2006.01) |
| ***B24C 3/12*** | (2006.01) |
| ***B24C 3/22*** | (2006.01) |
| ***B24C 3/28*** | (2006.01) |
| ***B24C 5/04*** | (2006.01) |

(58) Field of Classification Search
CPC .... B24C 3/28; B24C 5/02; B24C 5/04; B24C 49/00; B24C 49/12
USPC ..... 451/2, 6, 8, 9, 10, 11, 38, 102
See application file for complete search history.

(56) References Cited

U.S. PATENT DOCUMENTS

| | | | | |
|---|---|---|---|---|
| 2007/0167113 | A1* | 7/2007 | Klein | B24C 1/086 451/6 |
| 2008/0169275 | A1* | 7/2008 | Koseki | B23K 26/1476 219/121.75 |
| 2010/0193483 | A1* | 8/2010 | Chen | B23K 26/0823 219/121.72 |
| 2013/0025422 | A1* | 1/2013 | Chillman | B24C 1/045 83/53 |
| 2014/0273747 | A1* | 9/2014 | Markowski | B24C 1/04 451/2 |
| 2024/0339804 | A1* | 10/2024 | Le | B23K 26/067 |

* cited by examiner

JET POLISHING DEVICE FOR STABLY FORMING SHAPE OF GAUSSIAN REMOVAL FUNCTION

CROSS-REFERENCE TO RELATED APPLICATION

This application is based on and claims the benefit of priority from Chinese Patent Application No. 202111632010.3, filed on 28 Dec. 2021, the entirety of which is incorporated by reference herein.

TECHNICAL FIELD

The present disclosure relates to the technical field of jet polishing, and particularly to a jet polishing device for stably forming a shape of a Gaussian removal function.

BACKGROUND

With the continuous development of science and technology, an application range of an ultra-smooth component is more and more extensive, and requirements of machining accuracy and surface quality for an optical component are also increasing. A traditional polishing technology may cause problems such as a mechanical crushing defect and a pollution defect on a surface and a sub-surface of a workpiece, resulting in excessively high roughness of the surface of the workpiece. The appearance of a jet machining technology for an abrasive material effectively solves these problems, in which a material on the surface of the workpiece is removed in the elasticoplasticity field, without changing physical and mechanical properties of the material, and without causing defects such as thermal damage. Moreover, a tiny nozzle is not limited by a shape and a spatial location of the workpiece, and a surface of any complex shape may be polished.

In a process of jet machining of the abrasive material, the purpose of removing the material is mainly achieved through erosion and shearing actions generated by a collision between the abrasive material and the surface of the workpiece, wherein the shearing action plays a dominant role and affects a shape of a final removal function. When a jet is vertically injected onto the surface of the workpiece at an angle of 90°, the jet has an axial velocity which is the largest and a tangential velocity which is the smallest in a central region of the jet, which means that the shear force is the smallest. With the increase of a radial distance, the tangential velocity is increased first and then decreased, which means that the shear force is increased first and then decreased, so that the final removal function is "W"-shaped, and the material of the workpiece in the central region of the jet is hardly removed. However, a removal function with a central removal amount of approximate zero may easily increase a high frequency error of the surface of the workpiece, thus being not suitable for polishing and modifying an optical part. With the reduction of an injection angle, a polishing region is gradually changed from an annular shape to a meniscus shape in a certain range, and a maximum value of velocity distribution appears at a center of the jet, so that the removal amount of the material in the central region is increased.

At present, some research centers have developed a polishing device capable of forming a Gaussian removal function, but the polishing device still has some problems, such as debugging difficulty, inconvenient operation, low accuracy and incapability of stably forming the Gaussian removal function, thus having low reliability.

SUMMARY

The present disclosure aims to solve at least one of the technical problems in the existing technology. Therefore, the present disclosure provides a jet polishing device capable of stably forming a Gaussian removal function, with high reliability.

A jet polishing device capable of stably forming a Gaussian removal function according to some embodiments of the present disclosure includes: an auxiliary mounting mechanism; and a jet machining mechanism, wherein the jet machining mechanism is connected with the auxiliary mounting mechanism, the jet machining mechanism includes a rotation driving assembly, a positioning assembly and a jet machining assembly, the positioning assembly includes a linear guide rail, a slide mass, a first laser and a second laser, the rotation driving assembly is connected with the linear guide rail for driving the linear guide rail, the slide mass is slidably connected to the linear guide rail, the first laser is fixedly arranged relative to the linear guide rail, the jet machining assembly includes a mounting bracket fixedly connected with the slide mass, a nozzle mounting body rotatably connected to the mounting bracket and a nozzle arranged on the nozzle mounting body, and the second laser is connected with the nozzle mounting body; and the rotation driving assembly is capable of driving the nozzle to rotate around a rotation axis, laser light emitted by the first laser is capable of being used as a basis reference for adjusting the slide mass, a location of a machining center of a jet ejected from the nozzle on a surface of a workpiece to be machined is capable of being located on the rotation axis by adjusting a location of the slide mass according to the basis reference, and the first laser is further capable of providing reference data for adjusting a height between the nozzle and the workpiece to be machined; and the nozzle mounting body is capable of being operated to rotate so as to change an injection angle of the jet ejected from the nozzle, the nozzle mounting body is capable of driving the second laser to rotate during rotation, and the second laser is configured for measuring an inclination angle of the nozzle.

The jet polishing device capable of stably forming a Gaussian removal function according to the embodiments of the present disclosure has at least the following technical effects.

When the jet polishing device capable of stably forming a Gaussian removal function above is in use, the auxiliary mounting mechanism is configured for being fixed on a machine tool, thus fixing the whole jet polishing device, and a method for using the jet polishing device capable of stably forming a Gaussian removal function above includes following steps of:

fixing the workpiece to be machined on a platform of the machine tool through a clamp, and leveling the workpiece to be machined;

selecting the nozzle with an appropriate orifice size to mount on the nozzle mounting body;

turning on the first laser and the second laser, and finely adjusting the inclination angle of the nozzle according to a read number fed back by the second laser to ensure that the inclination angle of the nozzle is consistent with the ideal injection angle of the jet; and adjusting a height of the whole jet polishing device by the machine tool according to the reference data fed back by the first laser, thus adjusting a height distance between the nozzle and the workpiece to be machined;

pre-ejecting the jet, and adjusting the location of the slide mass according to the laser light emitted by the first laser, thus adjusting the location of the nozzle to ensure that an injection point of the jet ejected from the nozzle on the surface of the workpiece to be machined is on the rotation axis around which the nozzle is driven to rotate by the rotation driving assembly;

adding an appropriate amount of blended polishing solution into the jet polishing device, starting the jet polishing device again, setting a pressure of the jet and a rotation speed of the nozzle according to machining requirement, a surface shape parameter and other characteristics of the workpiece to be machined, and driving the nozzle to start to rotate by the rotation driving assembly; and after a pressure, a concentration, a flow rate, a temperature and other factors of the polishing solution are stabilized, running a machining program to start to polish, and precisely polishing the workpiece by controlling a dwell time and a moving track of the nozzle to realize material removal.

When the jet polishing device capable of stably forming a Gaussian removal function above is in use, the location of the nozzle can be accurately positioned by using the first laser and the second laser, and the height of the nozzle, the injection angle of the jet and the injection center of the jet can be accurately adjusted in time, thus stably obtaining an ideal shape of the Gaussian removal function on the surface of the workpiece, and realizing high reliability. Moreover, under actions of the first laser and the second laser, the height of the nozzle and the injection angle of the jet can be accurately changed, thus obtaining different Gaussian removal functions.

According to some embodiments of the present disclosure, the mounting bracket includes a first side plate and a second side plate arranged at an interval with the first side plate, the nozzle mounting body is rotatably arranged between the first side plate and the second side plate, the second laser is arranged on one side of the first side plate far away from the nozzle mounting body, and the second laser is arranged in parallel with the nozzle.

According to some embodiments of the present disclosure, the positioning assembly further includes an angle measurement member, the angle measurement member includes a dial and a pointer, the dial is fixed on one side of the second side plate far away from the nozzle mounting body, the pointer is connected with the nozzle mounting body, and the pointer points to a scale line on the dial.

According to some embodiments of the present disclosure, an axis of a rotating track of the nozzle relative to the mounting bracket is perpendicular to a moving track of the mounting bracket relative to the linear guide rail.

According to some embodiments of the present disclosure, in a case that a laser spot of the laser light emitted by the first laser on the surface of the workpiece to be machined coincides with a laser spot of laser light emitted by the second laser on the surface of the workpiece to be machined, the machining center of the jet ejected from the nozzle is on the rotation axis of the nozzle.

According to some embodiments of the present disclosure, the laser light emitted by the first laser is arranged in parallel with the rotation axis; and a horizontal component of an interval direction between the first laser and the second laser is parallel to a sliding direction of the slide mass relative to the linear guide rail.

According to some embodiments of the present disclosure, the jet machining mechanism further includes a buffer shell, the rotation driving assembly includes a rotating motor and a transmission shaft fixedly connected with an output shaft of the rotating motor, the transmission shaft is fixedly connected with the buffer shell, and the linear guide rail is fixedly connected with the buffer shell; and the buffer shell is provided with a buffer cavity, and the buffer cavity is communicated with the nozzle through a connecting pipe.

According to some embodiments of the present disclosure, the auxiliary mounting mechanism is provided with an accommodating cavity, and the rotating motor is arranged in the accommodating cavity.

According to some embodiments of the present disclosure, the auxiliary mounting mechanism includes a mounting box and a waterproof cover arranged on the mounting box, and the rotating motor is arranged in the mounting box.

According to some embodiments of the present disclosure, the auxiliary mounting mechanism further includes a brake plate, and the brake plate is configured for fixing the waterproof cover on the mounting box and restricting the waterproof cover from moving relative to the mounting box.

BRIEF DESCRIPTION OF THE DRAWINGS

The above and/or additional aspects and advantages of the present disclosure can become apparent and easy to understand from the description of embodiments with reference to the following drawings, wherein.

REFERENCE NUMERALS

Figure 1:
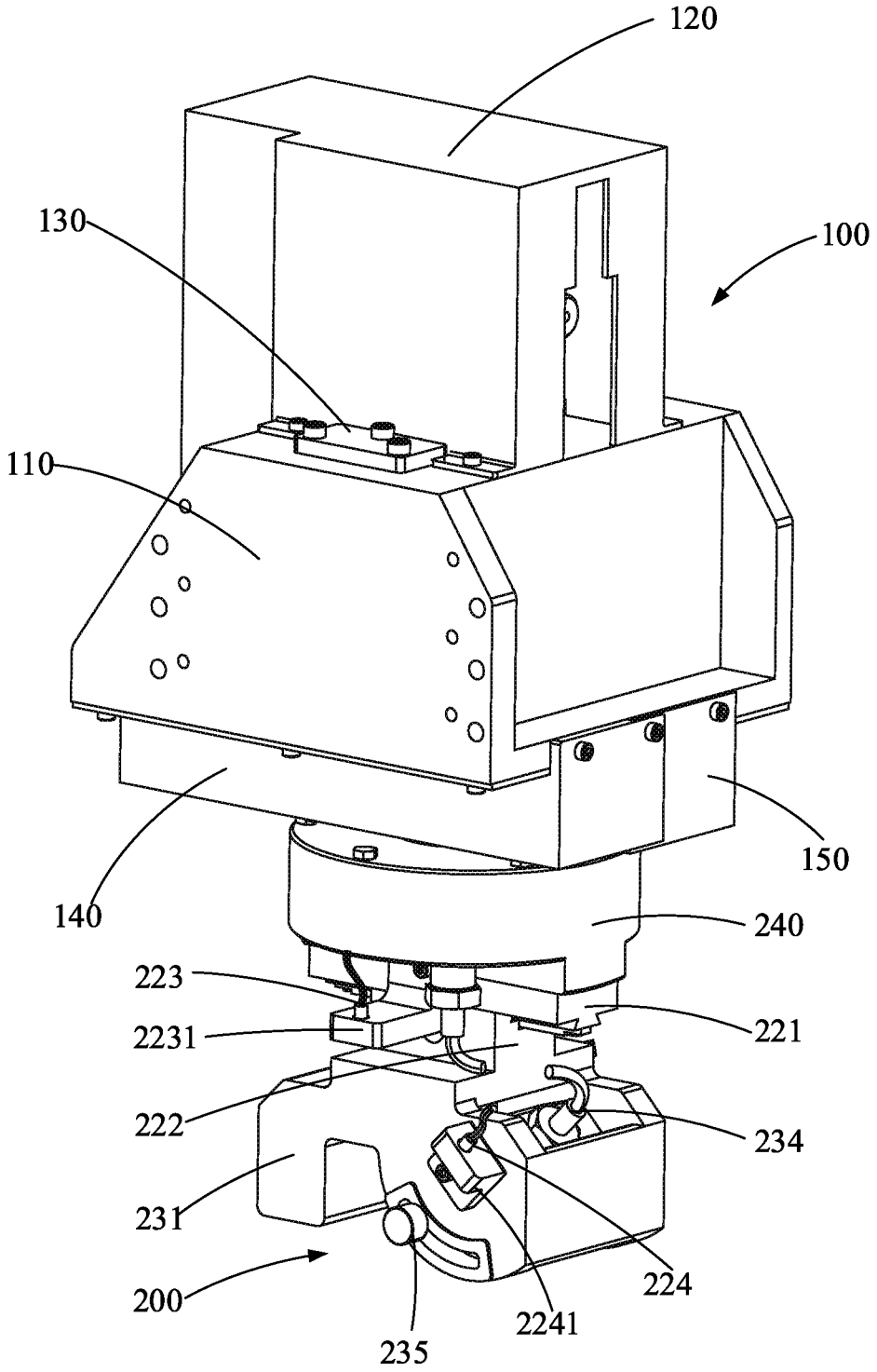
FIG. 1 is a first schematic diagram of a stereoscopic structure of a jet polishing device capable of stably forming a Gaussian removal function according to an embodiment of the present disclosure.

100 refers to auxiliary mounting mechanism; 110 refers to mounting box; 111 refers to accommodating cavity; 120 refers to waterproof cover; 130 refers to brake plate; 140 refers to first liquid stopper; 150 refers to second liquid stopper;

200 refers to jet machining mechanism; 211 refers to rotating motor; 212 refers to transmission shaft; 221 refers to linear guide rail; 222 refers to slide mass; 223 refers to first laser; 2231 refers to first bracket; 224 refers to second laser; 2241 refers to second bracket;

225 refers to pointer; 226 refers to dial; 231 refers to mounting bracket; 231*a* refers to laser hole; 2311 refers to first side plate; 2312 refers to second side plate; 232 refers to nozzle mounting body; 233 refers to nozzle; 234 refers to connecting pipe; 235 refers to adjusting button; and 240 refers to buffer shell.

DETAILED DESCRIPTION

Embodiments of the present disclosure are described hereinafter in detail, and illustrations of the embodiments are shown in the drawings, wherein identical or similar reference numerals denote identical or similar elements or elements having the same or similar functions. The embodiments described hereinafter with reference to the drawings are exemplary, and are only intended to explain the present disclosure, but should not be understood as limiting the present disclosure.

In the description of the present disclosure, it should be understood that the orientation or position relationship indicated by the terms "center", "longitudinal", "transverse", "length", "width", "thickness", "up", "down", "front", "rear", "left", "right", "vertical", "horizontal", "top", "bottom", "inside", "outside", "axial", "radial", "circumferential", and the like is based on the orientation or position relationship shown in the drawings, it is only for the convenience of description of the present disclosure and simplification of the description, and it is not to indicate or imply that the indicated device or element must have a specific orientation, and be constructed and operated in a specific orientation. Therefore, the terms should not be understood as limiting the present disclosure. In addition, the feature defined by "first" and "second" may explicitly or implicitly include one or more of the features. In the description of the present disclosure, the term "multiple" refers to being two or more, unless otherwise specified.

In the description of the present disclosure, it should be noted that the terms "mounting", "connected" and "connection" should be understood in a broad sense unless otherwise clearly specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present disclosure may be understood in a specific case by those of ordinary skills in the art.

As shown in FIG. 1, a jet polishing device capable of stably forming a Gaussian removal function according to an embodiment includes an auxiliary mounting mechanism 100 and a jet machining mechanism 200, and the jet machining mechanism 200 is connected with the auxiliary mounting mechanism 100.

The auxiliary mounting mechanism 100 is configured for being fixed on a machine tool, thus fixing the whole jet polishing device. The machine tool is selected from, but is not limited to a five-axis linkage numerically-controlled machine tool.

The jet machining mechanism 200 includes a rotation driving assembly, a positioning assembly and a jet machining assembly, the positioning assembly includes a linear guide rail 221, a slide mass 222, a first laser 223 and a second laser 224, the rotation driving assembly is connected with the linear guide rail 221 for driving the linear guide rail 221, the slide mass 222 is slidably connected to the linear guide rail 221, and the first laser 223 is fixedly arranged relative to the linear guide rail 221.

Figure 5:
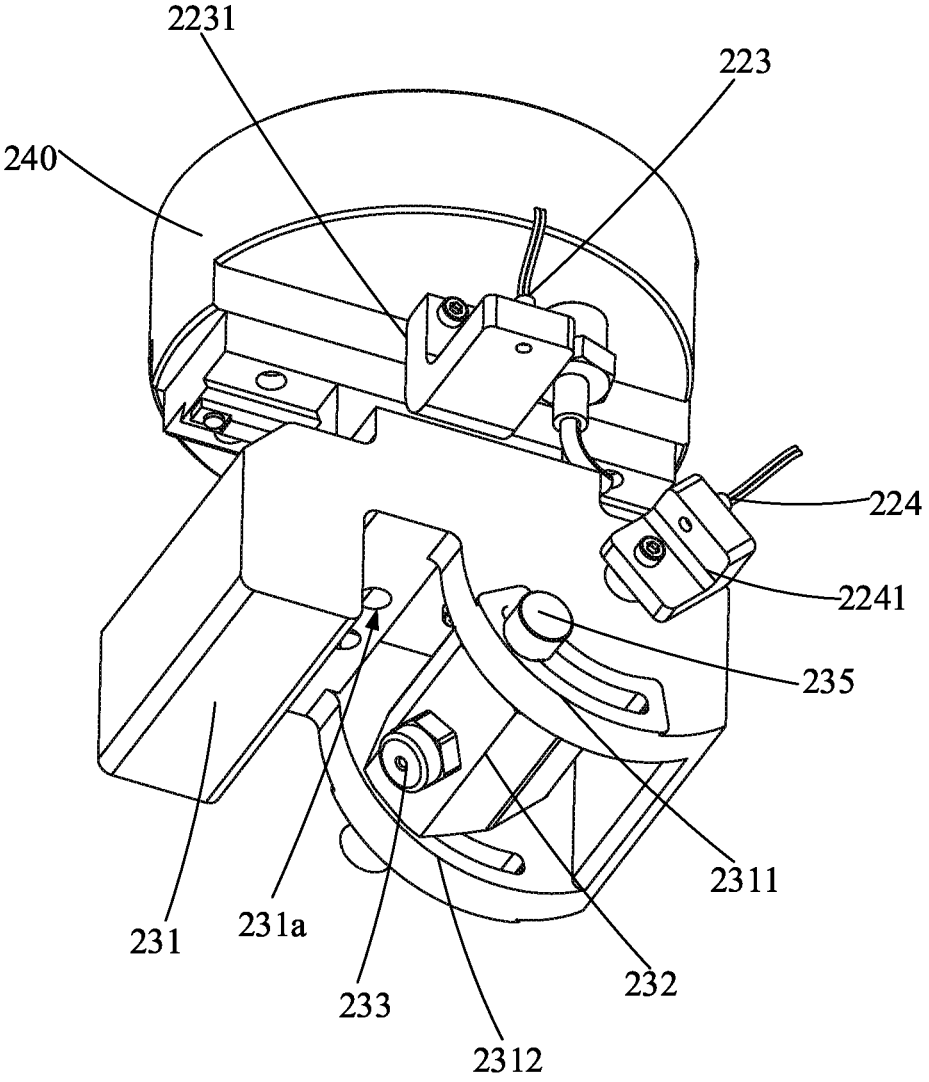
FIG. 5 is a second schematic diagram of the local structure of the jet polishing device capable of stably forming a Gaussian removal function according to the embodiment of the present disclosure.

With reference to FIG. 1 and FIG. 5, the jet machining assembly includes a mounting bracket 231 fixedly connected with the slide mass 222, a nozzle mounting body 232 rotatably connected to the mounting bracket 231 and a nozzle 233 arranged on the nozzle mounting body 232, and the second laser 224 is connected with the nozzle mounting body 232.

The rotation driving assembly is capable of driving the nozzle 233 to rotate around a rotation axis, laser light emitted by the first laser 223 is capable of being used as a basis reference for adjusting the slide mass 222, a location of a machining center of a jet ejected from the nozzle 233 on a surface of a workpiece to be machined is capable of being located on the rotation axis of the nozzle 233 by adjusting a location of the slide mass 222 according to the basis reference, and the first laser 223 is further capable of providing reference data for adjusting a height between the nozzle 233 and the workpiece to be machined. The nozzle mounting body 232 is capable of being operated to rotate so as to change an injection angle of the jet ejected from the nozzle 233, the nozzle mounting body 232 is capable of driving the second laser 224 to rotate during rotation, and the second laser 224 is configured for measuring an inclination angle of the nozzle 233.

With reference to FIG. 1 and FIG. 5, when the jet polishing device capable of stably forming a Gaussian removal function above is in use, the auxiliary mounting mechanism 100 is configured for being fixed on the machine tool, thus fixing the whole jet polishing device, and a method for using the jet polishing device capable of stably forming a Gaussian removal function above includes following steps of:

fixing the workpiece to be machined on a platform of the machine tool through a clamp, and leveling the workpiece to be machined;

selecting the nozzle 233 with an appropriate orifice size to mount on the nozzle mounting body 232;

turning on the first laser 223 and the second laser 224, and finely adjusting the inclination angle of the nozzle 233 according to a read number fed back by the second laser 224 to ensure that the inclination angle of the nozzle 233 is consistent with the ideal injection angle of the jet; and adjusting a height of the whole jet polishing device by the machine tool according to the reference data fed back by the first laser 223, thus adjusting a height distance between the nozzle 233 and the workpiece to be machined;

pre-ejecting the jet, and adjusting the location of the slide mass 222 according to the laser light emitted by the first laser 223, thus adjusting the location of the nozzle 233 to ensure that an injection point of the jet ejected from the nozzle 233 on the surface of the workpiece to be machined is on the rotation axis around which the nozzle 233 is driven to rotate by the rotation driving assembly;

adding an appropriate amount of blended polishing solution into the jet polishing device, starting the jet polishing device again, setting a pressure of the jet and a rotation speed of the nozzle 233 according to machining requirement, a surface shape parameter and other characteristics of the workpiece to be machined, and driving the nozzle 233 to start to rotate by the rotation driving assembly; and after a pressure, a concentration, a flow rate, a temperature and other factors of the polishing solution are stabilized, running a machining program to start to polish, and precisely polishing the workpiece by controlling a dwell time and a moving track of the nozzle 233 to realize material removal.

When the jet polishing device capable of stably forming a Gaussian removal function above is in use, the location of the nozzle 233 can be accurately positioned by using the first laser 223 and the second laser 224, and the height of the nozzle 233, the injection angle of the jet and the injection center of the jet can be accurately adjusted in time, thus stably obtaining an ideal shape of the Gaussian removal function on the surface of the workpiece, and realizing high reliability. Moreover, under actions of the first laser 223 and the second laser 224, the height of the nozzle 233 and the injection angle of the jet can be accurately changed, thus obtaining different Gaussian removal functions.

It should be noted that, in some embodiments, after changing the height of the nozzle 233 and the inclination angle of the nozzle 233, the height and the injection angle of the jet may be changed, and magnitudes and distributions of a pressure and a shear force acting on the surface of the workpiece may be changed without changing an original pressure of the jet, thus obtaining Gaussian removal functions in different shapes and related to a material removal depth in a cross section perpendicular to the surface of the workpiece.

Figure 4:
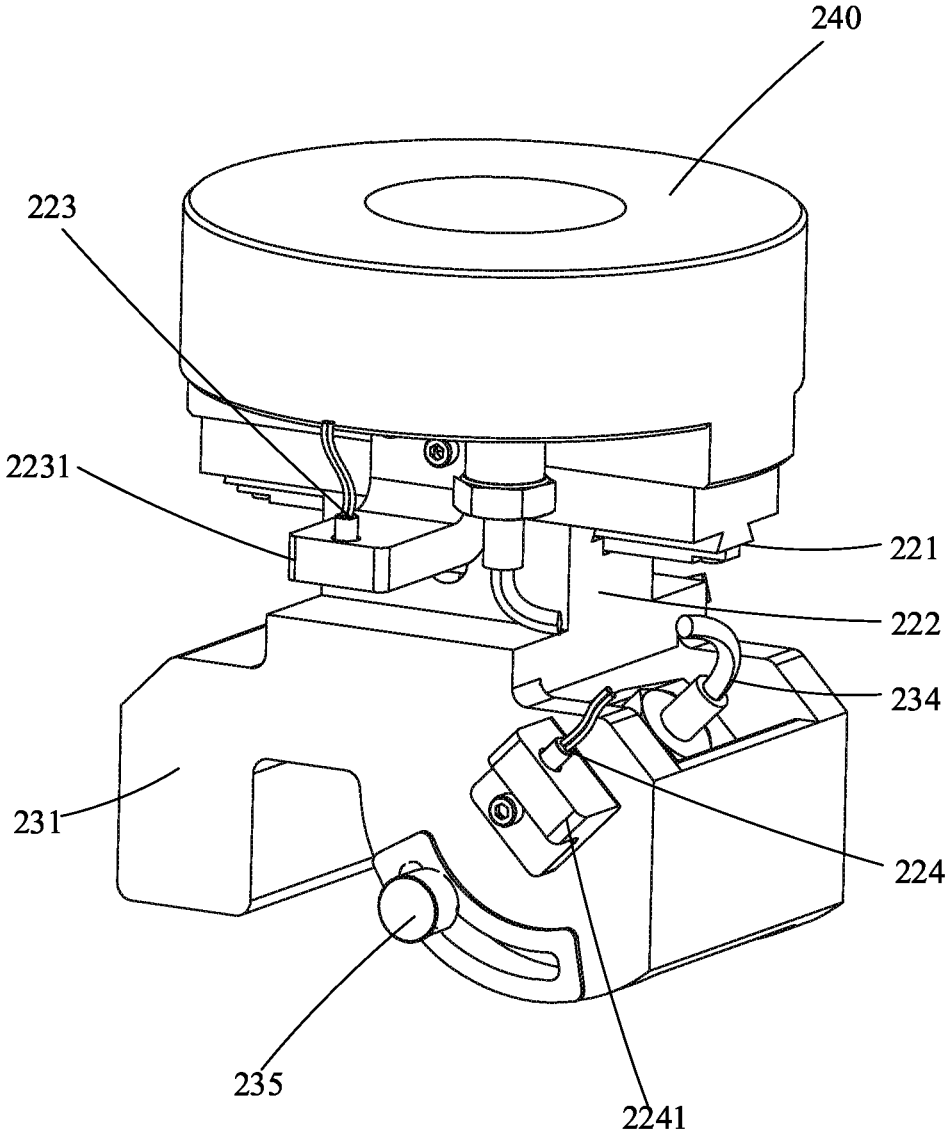
FIG. 4 is a first schematic diagram of a local structure of the jet polishing device capable of stably forming a Gaussian removal function according to the embodiment of the present disclosure.

As shown in FIG. 4 and FIG. 5, in one of the embodiments, the mounting bracket 231 includes a first side plate 2311 and a second side plate 2312 arranged at an interval with the first side plate 2311, the nozzle mounting body 232 is rotatably arranged between the first side plate 2311 and the second side plate 2312, the second laser 224 is arranged on one side of the first side plate 2311 far away from the nozzle mounting body 232, and the second laser 224 is arranged in parallel with the nozzle 233.

The nozzle mounting body 232 is rotatably arranged between the first side plate 2311 and the second side plate 2312, so that a space between the first side plate 2311 and the second side plate 2312 can be effectively used. The nozzle 233 is arranged on the nozzle mounting body 232, the second laser 224 is connected with the nozzle mounting body 232, and the nozzle mounting body 232 can drive the nozzle 233 and the second laser 224 to rotate together during rotation, so that the inclination angle of the nozzle 233 may be measured according to the laser light emitted by the second laser 224. The second laser 224 is arranged on one side of the first side plate 2311 far away from the nozzle mounting body 232, which can facilitate an operator to observe the laser light emitted by the second laser 224. After the laser light is emitted by the second laser 224, the second laser 224 is capable of generating data of an inclination angle of the laser light emitted by the second laser 224, and the inclination angle of the nozzle 233 can be known according to the data of the inclination angle of the laser light emitted by the second laser 224 generated by the second laser 224 by arranging the second laser 224 parallel with the nozzle 233, thus knowing the injection angle of the jet ejected from the nozzle 233.

Specifically, the second laser 224 is arranged on a second bracket 2241, a bolt is connected to the second bracket 2241, and the bolt rotatably penetrates through the first side plate 2311 and is fixedly connected with the nozzle mounting body 232.

Figure 2:
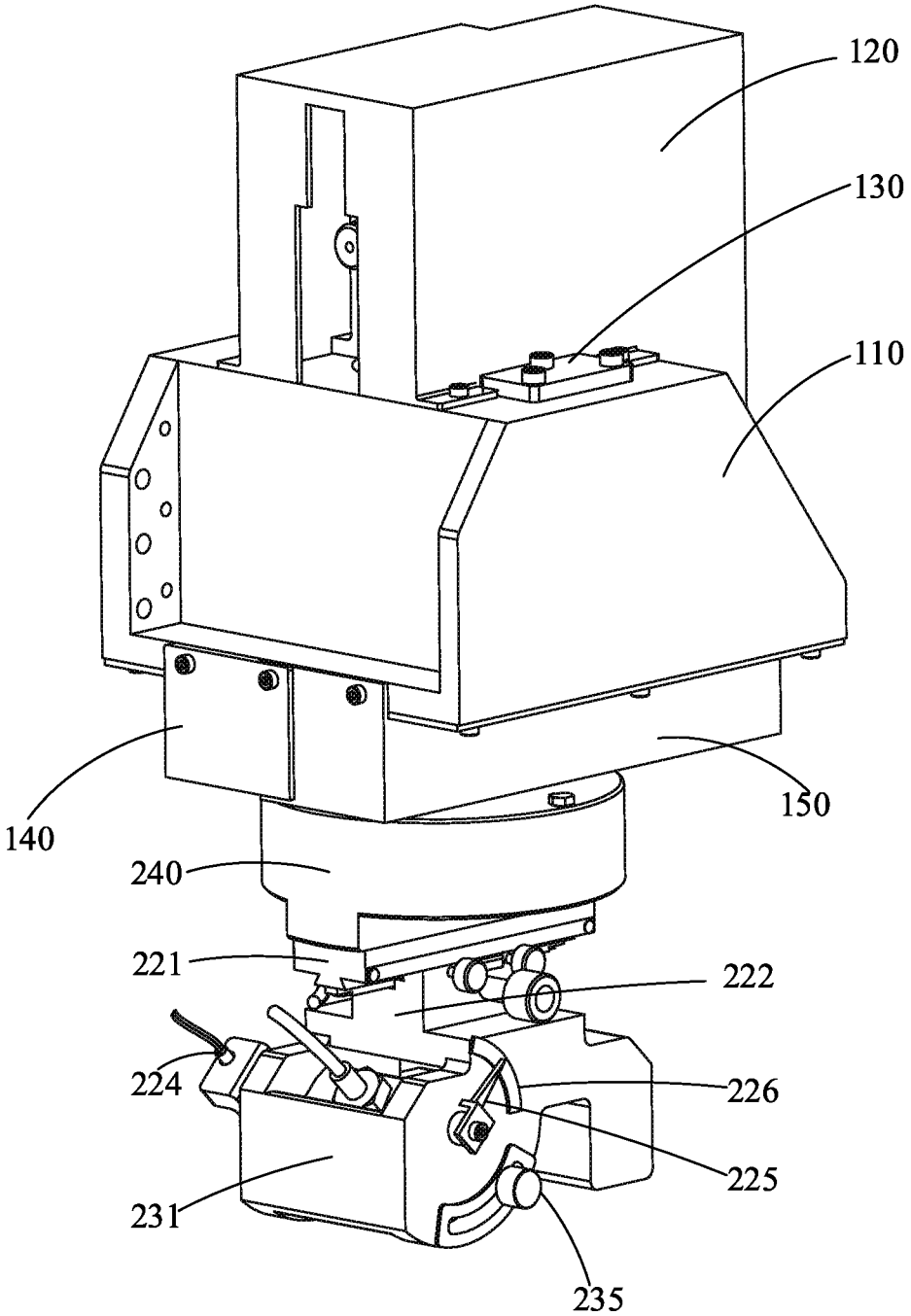
FIG. 2 is a second schematic diagram of the stereoscopic structure of the jet polishing device capable of stably forming a Gaussian removal function according to the embodiment of the present disclosure.

As shown in FIG. 2 and FIG. 5, in one of the embodiments, the positioning assembly further includes an angle measurement member, the angle measurement member includes a dial 226 and a pointer 225, the dial 226 is fixed on one side of the second side plate 2312 far away from the nozzle mounting body 232, the pointer 225 is connected with the nozzle mounting body 232, and the pointer 225 points to a scale line on the dial 226. The nozzle mounting body 232 drives the pointer 225 to rotate together during rotation, and the inclination angle of the nozzle 233 may be preliminarily determined by pointing the pointer 225 to a location of the dial 226, so that the inclination angle of the nozzle 233 may be roughly adjusted, and after the inclination angle of the nozzle 233 is roughly adjusted, the inclination angle of the nozzle 233 may be finely adjusted by using the second laser 224.

Specifically, a bolt is connected to the pointer 225, and the bolt rotatably penetrates through the second side plate 2312 and is fixedly connected with the nozzle mounting body 232.

With reference to FIG. 4 and FIG. 5, in one of the embodiments, an axis of a rotating track of the nozzle 233 relative to the mounting bracket 231 is perpendicular to a moving track of the mounting bracket 231 relative to the linear guide rail 221.

Specifically, the rotating track of the nozzle 233 relative to the mounting bracket 231 is arc-shaped, the moving track of the mounting bracket 231 relative to the linear guide rail 221 is straight, and the axis of the rotating track of the nozzle 233 relative to the mounting bracket 231 is perpendicular to the moving track of the mounting bracket 231 relative to the linear guide rail 221, so that a component of the rotating track of the nozzle 233 relative to the mounting bracket 231 in a horizontal diction is parallel to the moving track of the mounting bracket 231 relative to the linear guide rail 221. In this way, a location of the machining center of the jet ejected from the nozzle 233 on the workpiece to be machined can be changed by making the slide mass 222 slide on the linear guide rail 221, so that the machining center of the jet ejected from the nozzle 233 can be positioned on the rotation axis around which the nozzle 233 is driven to rotate by the rotation driving assembly by moving the slide mass 222.

Further, the first laser 223 is arranged on the first bracket 2231, the first laser 223 is oriented downwardly, and the laser light emitted by the first laser 223 is configured for being vertically irradiated on the surface of the workpiece to be machined, so that after the first laser 223 is started, the first laser 223 is capable of generating data of a height distance between the first laser 223 and the workpiece to be machined, thus knowing the height distance between the nozzle 233 and the workpiece to be machined through the data of the height distance between the first laser 223 and the workpiece to be machined.

Further, the first laser 223 and the second laser 224 are positioned to ensure that, when a laser spot of the laser light emitted by the first laser 223 on the surface of the workpiece to be machined coincides with a laser spot of laser light emitted by the second laser 224 on the surface of the workpiece to be machined, the machining center of the jet ejected from the nozzle 233 is on the rotation axis around which the nozzle 233 is driven to rotate by the rotation driving assembly.

Specifically, the laser light emitted by the first laser 223 is parallel to the rotation axis around which the nozzle 233 is driven to rotate by the rotation driving assembly, and a horizontal component of an interval direction between the first laser 223 and the second laser 224 is parallel to a sliding direction of the slide mass 222 relative to the linear guide rail 221.

When the location of the nozzle 233 is adjusted, the inclination angle of the nozzle 233 needs to be adjusted according to the second laser 224 first, and in a process of adjusting the inclination angle of the nozzle 233, the laser light emitted by the second laser 224 may also be deflected, so that the laser spot of the laser light emitted by the second laser 224 on the surface of the workpiece to be machined may be moved. Then, since the first laser 223 is fixedly arranged relative to the linear guide rail 221, a location of the laser spot of the laser light emitted by the second laser 224 on the surface of the workpiece to be machined may be changed by moving the slide mass 222, and when the laser spot of the laser light emitted by the first laser 223 on the surface of the workpiece to be machined coincides with the laser spot of the laser light emitted by the second laser 224 on the surface of the workpiece to be machine, it is indicated that the machining center of the jet ejected from the nozzle 233 is on the rotation axis around which the nozzle 233 is driven to rotate by the rotation driving assembly.

In one of the embodiments, a third laser (not shown) is further arranged in the mounting bracket 231, and the third laser is configured for measuring a polishing depth at a polishing point after the workpiece is polished.

As shown in FIG. 5, specifically, a bottom portion of the mounting bracket 231 is provided with a laser hole 231*a*, and the third laser is arranged in the mounting bracket 231 and is arranged towards the laser hole 231*a*.

In other embodiments, the third laser is capable of being configured for softening a workpiece material with the laser light to assist jet polishing.

As shown in FIG. 5, in one of the embodiments, an adjusting button 235 is further connected to the nozzle mounting body 232, and the nozzle mounting body 232 may be rotated by pushing the adjusting button 235, thus realizing simpler operation.

Figure 3:
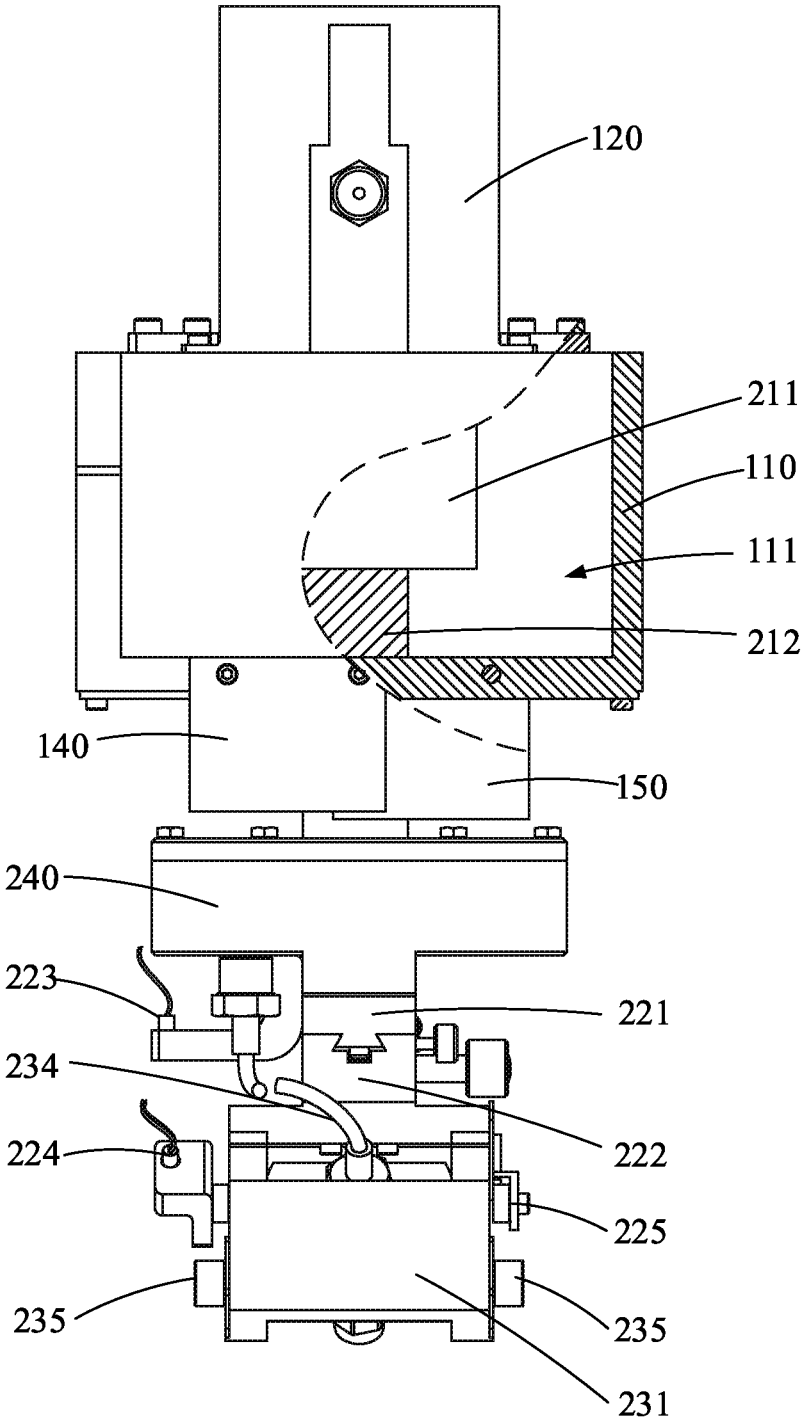
FIG. 3 is a schematic diagram of a rear-view structure of the jet polishing device capable of stably forming a Gaussian removal function according to the embodiment of the present disclosure.

With reference to FIG. 2 and FIG. 3, in one of the embodiments, the jet machining mechanism 200 further includes a buffer shell 240, the rotation driving assembly includes a rotating motor 211 and a transmission shaft 212 fixedly connected with an output shaft of the rotating motor 211, the transmission shaft 212 is fixedly connected with the buffer shell 240, and the linear guide rail 221 is fixedly connected with the buffer shell 240.

Specifically, the transmission shaft 212 is driven to rotate when the rotating motor 211 is started, and the buffer shell 240 and the linear guide rail 221 are driven to rotate when the transmission shaft 212 is rotated, thus rotating the slide mass 222, the first laser 223, the second laser 224, the mounting bracket 231, the nozzle 233 and other components.

Further, the buffer shell 240 is provided with a buffer cavity, and the buffer cavity is communicated with the nozzle 233 through a connecting pipe 234.

The polishing solution enters the buffer cavity first before reaching the nozzle 233, the buffer cavity functions to slow down and buffer the polishing solution before entering the nozzle 233, so as to prevent the polishing solution from being rapidly diverged and broken after leaving the nozzle 233 due to excessive impact and punching with the nozzle 233, thus losing capabilities of polishing and removal.

With reference to FIG. 2 and FIG. 3, in one of the embodiments, the auxiliary mounting mechanism 100 is provided with an accommodating cavity 111, the rotating motor 211 is arranged in the accommodating cavity 111, and the auxiliary mounting mechanism 100 is configured for providing a mounting space for the rotating motor 211.

Further, the auxiliary mounting mechanism 100 includes a mounting box 110 and a waterproof cover 120 arranged on the mounting box 110, the mounting box 110 is provided with the accommodating cavity 111, the rotating motor 211 is arranged in the accommodating cavity 111, and the waterproof cover 120 is configured for waterproofing, so as to avoid external liquids from entering the mounting box 110 to affect normal use of the rotating motor 211.

Further, the auxiliary mounting mechanism 100 further includes a brake plate 130, and the brake plate 130 is configured for fixing the waterproof cover 120 on the mounting box 110 and restricting the waterproof cover 120 from moving relative to the mounting box 110. In this way, it can be avoided that a vibration amplitude of the whole jet polishing device is excessively large due to the movement of the waterproof cover 120 and affect the polishing effect.

With reference to FIG. 2 and FIG. 3, in one of the embodiments, the auxiliary mounting mechanism 100 further includes a first liquid stopper 140 and a second liquid stopper 150, and the first liquid stopper 140 and the second liquid stopper 150 are arranged at a bottom portion of the mounting box 110 for stopping liquids from entering the mounting box 110 to affect normal work of the rotating motor 211.

Further, a bottom portion of a structure formed by the first liquid stopper 140 and the second liquid stopper 150 is provided with a central hole, and the central hole is configured for the transmission shaft 212 to penetrate through.

Further, a bottom plate of the second liquid stopper 150 extends below a bottom plate of the first liquid stopper 140, thus preventing the liquid from entering the mounting box 110 from a gap between the first liquid stopper 140 and the second liquid stopper 150.

A method for using the jet polishing device capable of stably forming a Gaussian removal function above includes following steps of:

S1: fixing the workpiece to be machined on a platform of the machine tool through a clamp, and leveling the workpiece to be machined;

S2: selecting the nozzle 233 with an appropriate orifice size to mount on the nozzle mounting body 232;

S3: turning on the first laser 223 and the second laser 224, roughly adjusting an angle of the nozzle 233 by an angle adjustment member first, then finely adjusting the inclination angle of the nozzle 233 according to a read number fed back by the second laser 224, to ensure that the inclination angle of the nozzle 233 is consistent with the ideal injection angle of the jet; and adjusting a height of the whole jet polishing device by the machine tool according to the reference data fed back by the first laser 223, thus adjusting a height distance between the nozzle 233 and the workpiece to be machined;

S4: pre-ejecting the jet, and adjusting the location of the slide mass 222 according to the laser light emitted by the first laser 223, thus adjusting the location of the nozzle 233 to ensure that an injection point of the jet ejected from the nozzle 233 on the surface of the workpiece to be machined is on the rotation axis around which the nozzle 233 is driven to rotate by the rotation driving assembly;

S5: adding an appropriate amount of blended polishing solution into the jet polishing device, starting the jet polishing device again, setting a pressure of the jet and a rotation speed of the nozzle 233 according to machining requirement, a surface shape parameter and other characteristics of the workpiece to be machined, and driving the nozzle 233 to start to rotate by the rotation driving assembly;

S6: after a pressure, a concentration, a flow rate, a temperature and other factors of the polishing solution are stabilized, running a machining program to start to polish, and precisely polishing the workpiece by controlling a dwell time and a moving track of the nozzle 233 to realize material removal; and S7: recycling the polishing solution.

In the descriptions of the specification, the descriptions with reference to the terms "one embodiment", "some embodiments", "illustrative embodiment", "example", "specific example" or "some examples", etc., refer to that specific features, structures, materials, or characteristics described with reference to the embodiments or examples are included in at least one embodiment or example of the present disclosure. In the specification, the schematic representation of the above terms does not necessarily mean the same embodiment or example. Moreover, the specific features, structures, materials or characteristics described may be combined in any one or more embodiments or examples in a suitable manner.

Although the embodiments of the present disclosure have been shown and described, those of ordinary skills in the art should understand that: various changes, amendments, substitutions and modifications can be made to these embodiments without departing from the principles and purposes of the present disclosure, and the scope of the present disclosure is defined by the claims and equivalents thereof.

What is claimed is:

1. A jet polishing device, comprising:

an auxiliary mounting mechanism; and a jet machining mechanism, wherein the jet machining mechanism is connected with the auxiliary mounting mechanism, the jet machining mechanism comprises a rotation driving assembly, a positioning assembly and a jet machining assembly, the positioning assembly comprises a linear guide rail, a slide mass, a first laser and a second laser, the rotation driving assembly is connected with the linear guide rail for driving the linear guide rail, the slide mass is slidably connected to the linear guide rail, the first laser is fixedly arranged relative to the linear guide rail, the jet machining assembly comprises a mounting bracket fixedly connected with the slide mass, a nozzle mounting body rotatably connected to the mounting bracket and a nozzle arranged on the nozzle mounting body, and the second laser is connected with the nozzle mounting body; and wherein the rotation driving assembly is capable of driving the nozzle to rotate around a rotation axis, laser light emitted by the first laser is capable of being used as a basis reference for adjusting the slide mass, a location of a machining center of a jet ejected from the nozzle on a surface of a workpiece to be machined is capable of being located on the rotation axis by adjusting a location of the slide mass according to the basis reference, and the first laser is further capable of providing reference data for adjusting a height between the nozzle and the workpiece to be machined; and the nozzle mounting body is capable of being operated to rotate so as to change an injection angle of the jet ejected from the nozzle, the nozzle mounting body is capable of driving the second laser to rotate during rotation, and the second laser is configured for measuring an inclination angle of the nozzle.

2. The jet polishing device according to claim 1, wherein the mounting bracket comprises a first side plate and a second side plate arranged at an interval with the first side plate, the nozzle mounting body is rotatably arranged between the first side plate and the second side plate, the second laser is arranged on one side of the first side plate far away from the nozzle mounting body, and the second laser is arranged in parallel with the nozzle.

3. The jet polishing device according to claim 2, wherein the positioning assembly further comprises an angle measurement member, the angle measurement member comprises a dial and a pointer, the dial is fixed on one side of the second side plate far away from the nozzle mounting body, the pointer is connected with the nozzle mounting body, and the pointer points to a scale line on the dial.

4. The jet polishing device according to claim 1, wherein an axis of a rotating track of the nozzle relative to the mounting bracket is perpendicular to a moving track of the mounting bracket relative to the linear guide rail.

5. The jet polishing device according to claim 1, wherein in a case that a laser spot of the laser light emitted by the first laser on the surface of the workpiece to be machined coincides with a laser spot of laser light emitted by the second laser on the surface of the workpiece to be machined, the machining center of the jet ejected from the nozzle is on the rotation axis of the nozzle.

6. The jet polishing device according to claim 5, wherein the laser light emitted by the first laser is arranged in parallel with the rotation axis; and a horizontal component of an interval direction between the first laser and the second laser is parallel to a sliding direction of the slide mass relative to the linear guide rail.

7. The jet polishing device according to claim 1, wherein the jet machining mechanism further comprises a buffer shell, the rotation driving assembly comprises a rotating motor and a transmission shaft fixedly connected with an output shaft of the rotating motor, the transmission shaft is fixedly connected with the buffer shell, and the linear guide rail is fixedly connected with the buffer shell; and the buffer shell is provided with a buffer cavity, and the buffer cavity is communicated with the nozzle through a connecting pipe.

8. The jet polishing device according to claim 7, wherein the auxiliary mounting mechanism is provided with an accommodating cavity, and the rotating motor is arranged in the accommodating cavity.

9. The jet polishing device according to claim 7, wherein the auxiliary mounting mechanism comprises a mounting box and a waterproof cover arranged on the mounting box, and the rotating motor is arranged in the mounting box.

10. The jet polishing device according to claim 9, wherein the auxiliary mounting mechanism further comprises a brake plate, and the brake plate is configured for fixing the waterproof cover on the mounting box and restricting the waterproof cover from moving relative to the mounting box.

* * * * *